US011090218B2

(12) United States Patent
Henniger

(10) Patent No.: US 11,090,218 B2
(45) Date of Patent: Aug. 17, 2021

(54) SOFT TISSUE MOBILIZATION DEVICE

(71) Applicant: Coulter Ventures, LLC, Columbus, OH (US)

(72) Inventor: William Henniger, Columbus, OH (US)

(73) Assignee: Coulter Ventures, LLC, Columbus, OH (US)

( * ) Notice: Subject to any disclaimer, the term of this patent is extended or adjusted under 35 U.S.C. 154(b) by 403 days.

(21) Appl. No.: 15/357,483

(22) Filed: Nov. 21, 2016

(65) Prior Publication Data

US 2017/0143579 A1 May 25, 2017

Related U.S. Application Data

(60) Provisional application No. 62/257,435, filed on Nov. 19, 2015.

(51) Int. Cl.
*A61H 15/00* (2006.01)
*A61H 7/00* (2006.01)

(52) U.S. Cl.
CPC ..... *A61H 15/0092* (2013.01); *A61H 7/001* (2013.01); *A61H 7/007* (2013.01); *A61H 2015/0014* (2013.01); *A61H 2201/0119* (2013.01); *A61H 2201/1284* (2013.01); *A61H 2201/164* (2013.01); *A61H 2201/169* (2013.01); *A61H 2203/0437* (2013.01); *A61H 2205/10* (2013.01)

(58) Field of Classification Search
CPC ..... A61H 1/008; A61H 7/001; A61H 15/00; A61H 15/0092; A61H 2015/0007; A61H 2015/0014; A61H 7/007; A61H 39/04; A63B 21/072; A63B 21/0724; A63B 21/0726
See application file for complete search history.

(56) References Cited

U.S. PATENT DOCUMENTS

| | | | | | |
|---|---|---|---|---|---|
| 1,998,197 | A * | 4/1935 | Lang | A61H 15/00 | 119/531 |
| 5,135,455 | A * | 8/1992 | King | A63B 21/0726 | 482/105 |
| 2004/0089771 | A1* | 5/2004 | Pap | A47B 21/0371 | 248/118.1 |
| 2010/0173757 | A1* | 7/2010 | Ma | A63B 21/0552 | 482/93 |
| 2011/0054369 | A1* | 3/2011 | DeStefano | A61H 7/001 | 601/135 |
| 2013/0030332 | A1* | 1/2013 | Ingrassia | A61H 15/0092 | 601/19 |
| 2014/0349821 | A1* | 11/2014 | Davis | A63B 21/0552 | 482/122 |

(Continued)

*Primary Examiner* — Valerie L Woodward
(74) *Attorney, Agent, or Firm* — The Watson IP Group, PLC; Jovan N. Jovanovic

(57) ABSTRACT

A soft tissue mobilization device having an elongated body. The elongated body is a generally right cylindrical member that has a first end and a second end. The cross-sectional configuration is substantially uniform. Surface variations may be present along the length thereof. The first and second ends may include a round, with a flat region there within. A stand upon which the soft tissue mobilization device can be positioned is likewise disclosed. Methods of use are likewise disclosed.

18 Claims, 10 Drawing Sheets

(56) References Cited

U.S. PATENT DOCUMENTS

| | | | | |
|---|---|---|---|---|
| 2015/0038302 | A1* | 2/2015 | O'Brien | A63B 21/0724<br>482/107 |
| 2015/0133271 | A1* | 5/2015 | Jones | A61H 15/00<br>482/51 |
| 2016/0325134 | A1* | 11/2016 | Riccoboni | A63B 21/0004 |

* cited by examiner

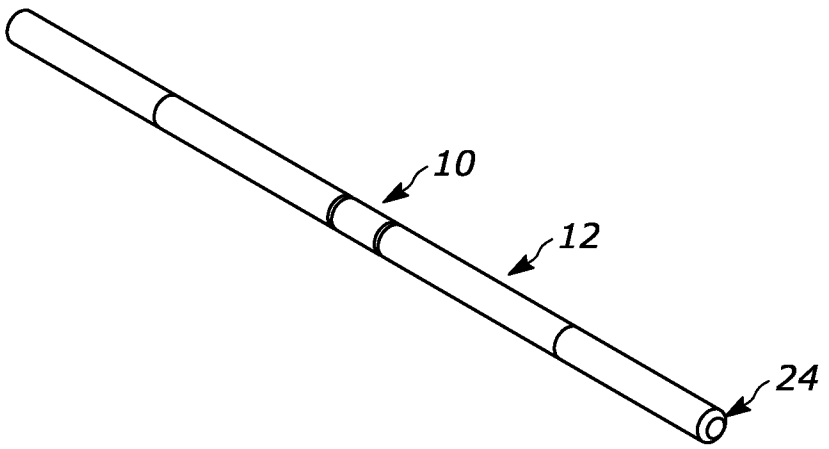
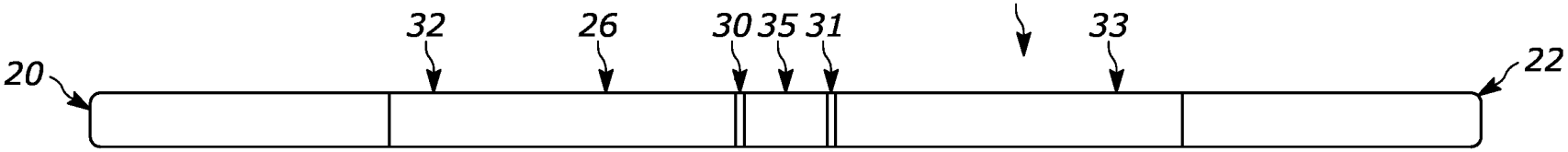
FIG. 6
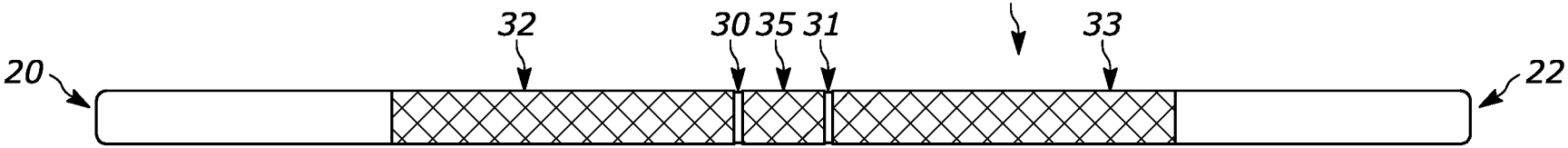
FIG. 7
FIG. 8

SOFT TISSUE MOBILIZATION DEVICE

CROSS-REFERENCE TO RELATED APPLICATION

This application claims priority from U.S. Pat. App. Ser. No. 62/257,435 filed Nov. 19, 2015, entitled "Soft Tissue Mobilization Device," the entire specification of which is hereby incorporated by reference in its entirety.

BACKGROUND OF THE DISCLOSURE

1. Field of the Disclosure

The disclosure relates in general to soft tissue treatment devices, and more particularly, to a soft tissue mobilization device.

2. Background Art

The use of soft tissue treatment devices is known in the art. Among other devices, devices which break up tissue to help with mobilization are known. Many of these devices, such as "the Stick" offered by The Stick/RPI of Atlanta located in Atlanta Ga. comprises a polymer based stick with rotatable rings positioned thereon. Among other issues, the device lacks the necessary strength and will bend easily under load.

The present disclosure is configured to overcome some of the deficiencies in the prior art, and to provide a device which improves soft tissue mobilization.

SUMMARY OF THE DISCLOSURE

The disclosure is directed to a soft tissue mobilization device having an elongated body. The elongated body is a generally right cylindrical member that has a first end and a second end. The cross-sectional configuration is substantially uniform. Surface variations may be present along the length thereof. The first and second ends may include a round, with a flat region there within.

Methods of use are likewise disclosed. For example, the end can be directed into the soft tissue, or the elongated body can be pressed and/or rolled against the body. In other configurations, the soft tissue can be pressed and rolled against the elongated body, wherein the elongated body is suspended between two stands. Other variations are contemplated.

In an aspect of the disclosure, the disclosure is directed to a soft tissue mobilization device comprising an elongated body having a cross-sectional configuration, which elongated body has a tensile strength of at least about 190,000 PSI.

In some configurations, the cross-sectional configuration is substantially circular, so as to define a cylindrical configuration.

In some configurations, the soft tissue mobilization device may further include a first end and a second end, wherein each of the first and second ends include a rounded edge.

In some configurations, the elongated body has a length that is between 16" and 30" in length.

In some configurations, the elongated body has a diameter of about 1.125".

In some configurations, a plurality of surface variations extending along an outer surface of the soft tissue mobilization device. In some configurations, the surface variations comprise a knurling.

In some configurations, the elongated body includes a central portion and opposing wing portions. The central portion and the wing portions include surface variation with a pair of slots positioned between the central portion and each of the opposing wing portions.

In some configurations, the elongated body is substantially symmetrical about the central portion.

In some configurations, the rounded edge comprises a radius of about 0.25".

In another aspect of the disclosure, the disclosure is directed to a soft tissue mobilization device consisting of an elongated body having a cross-sectional configuration, which elongated body has a tensile strength of at least about 190,000 PSI, wherein the cross-sectional configuration is substantially circular, so as to define a cylindrical configuration, wherein the elongated body has a length that is between 16" and 30" in length, a diameter of about 1.125" and further including a first end and a second end, wherein each of the first and second ends include a rounded edge.

In some configurations, the soft tissue mobilization device may further consist of a surface variation disposed therealong.

In another aspect of the disclosure, the disclosure is directed to a combination stand and soft tissue mobilization device. The stand comprises a base and a cradle structure. The base has a first side and a second side. The base has a lower surface positionable to overlie an outside surface and a upper surface opposite thereof. The cradle structure is positioned at each of the first side of the base and the second side of the base. Each cradle structure includes a slot defined between opposing peaks. The soft tissue mobilization device includes an elongated body having a substantially circular cross-sectional configuration and having a first end and a second end. The first end is releasably positionable within the slot defined in the cradle structure at the first side and the second end is releasably positionable within the slot defined in the cradle structure at the second side, so as to span therebetween in a position that is spaced apart from the upper surface.

In some configurations, the elongated body has a tensile strength of at least about 190,000 PSI.

In some configurations, the elongated body is rotatable about an axis defined by the slots of the cradle structure at each of the first side and the second side of the base.

In some configurations, the elongated body is substantially precluded from movement within the slot of each of the first and second side in a side to side direction.

In yet another aspect of the disclosure, the disclosure is directed to a stand that is configured to receive and retain a soft tissue mobilization device. The stand includes a base and a cradle. The base has a first side and a second side. The base has a lower surface positionable to overlie an outside surface and a upper surface opposite thereof. The cradle structure is positioned at each of the first side of the base and the second side of the base. Each cradle structure includes a slot defined between opposing peaks. The slot of each of the first side of the base and the second side of the base are spaced apart from each other and configured to receive the soft tissue mobilization device therebetween in a configuration that extends the soft tissue mobilization over the base in a spaced apart configuration.

In some configurations, the base further includes opposing wall structure positioned at each of the first side and the second side of the base. Each opposing wall structure further comprises an upstanding wall and an inward flange. The upstanding wall extends upwardly from the upper surface of the base. The inward flange extends from the upstanding wall spaced apart from the upper surface of the base. The cradle structure of each of the first side and the second side are coupled to the inward flange on a mounting surface thereof.

In some configurations, the upstanding wall is substantially perpendicular to the base, and the inward flange is substantially parallel to the upper surface of the base.

In some configurations, the base and the opposing wall structure are integrally formed.

BRIEF DESCRIPTION OF THE DRAWINGS

The disclosure will now be described with reference to the drawings wherein:

FIG. 6 of the drawings is a perspective view of another embodiment of the soft tissue mobilization device;

FIG. 7 of the drawings is a side elevational view of the embodiment of the soft tissue mobilization device shown in FIG. 6;

FIG. 8 of the drawings is a side elevational view of the embodiment of the soft tissue mobilization device shown in FIG. 6;

DETAILED DESCRIPTION OF THE DISCLOSURE

Figure 1:
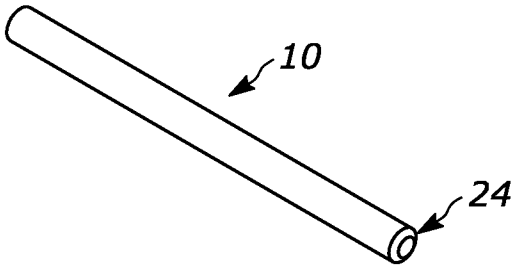
FIG. 1 of the drawings is a perspective view of an embodiment of the soft tissue mobilization device.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 8, the soft tissue mobilization device is shown generally at 10. It will be understood that the soft tissue mobilization device can be utilized to apply force onto soft tissue of the body, to, in turn, mobilize tissue, floss tissue, and otherwise improve mobility and muscle soreness of a user. Problematically, many past devices for the same lack the requisite rigidity to effectively apply the force necessary onto the user's soft tissue.

The device generally comprises an elongated body 12. In the configuration shown, the elongated body extends from first end 20 to second end 22. The elongated body generally comprises a substantially cylindrical member defining a right cylindrical member. The first end 20 and the second end 22 include a round 24 that is, for example of a 0.25" diameter. The diameter is large enough so as to remove a sharp corner, without introducing a pointed end; rather, having a flat end at both the first end and the second end, with the round extending at the outer edges thereof. In the configuration shown, the first and second ends include a flat circular configuration which is the difference between the rounding radius, and the 1.125" (or 28.5 mm) diameter of the elongated body. In the configuration shown, the first end and the second end are substantially identical.

The elongated body further includes a cross-sectional configuration which is generally circular, and, at its outermost diameter is about 1.125" (or about 28.5 mm). It will be understood that surface variations, such as surface variations 26 may be positioned along the length thereof. For example, a number of different lengths are contemplated, such as, for example, a length of approximately 16" to a length of approximately 30". Of course, the disclosure is not limited to such lengths, however such lengths or lengths therebetween have shown to be particularly effective.

Figure 2:
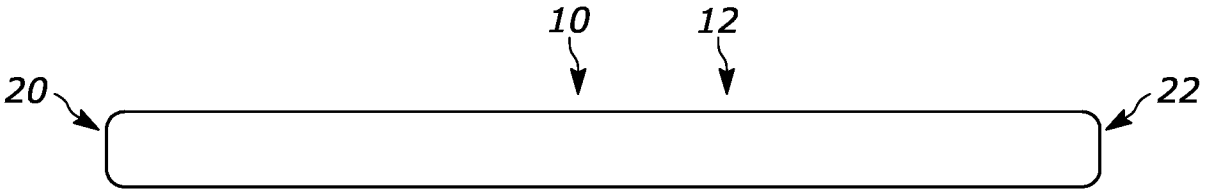
FIG. 2 of the drawings is a side elevational view of the embodiment of the soft tissue mobilization device shown in FIG. 1.

In one configuration, such as the configuration shown in FIGS. 1 and 2, the elongated body may be substantially uniform from the first end to the second end, with only the end rounds altering the cross-sectional configuration between the first end and the second end. Such a configuration may be any length, although lengths of 16" and 30" are specifically contemplated. These are merely exemplary and not to be deemed limiting, although, the properties of the elongated body are such that such relatively long lengths without having bending are possible.

Figure 3:
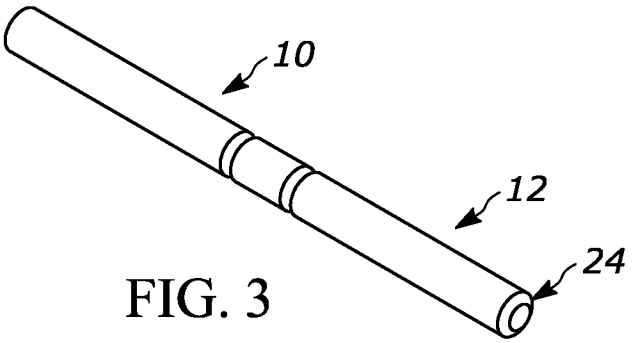
FIG. 3 of the drawings is a perspective view of another embodiment of the soft tissue mobilization device.
Figure 4:
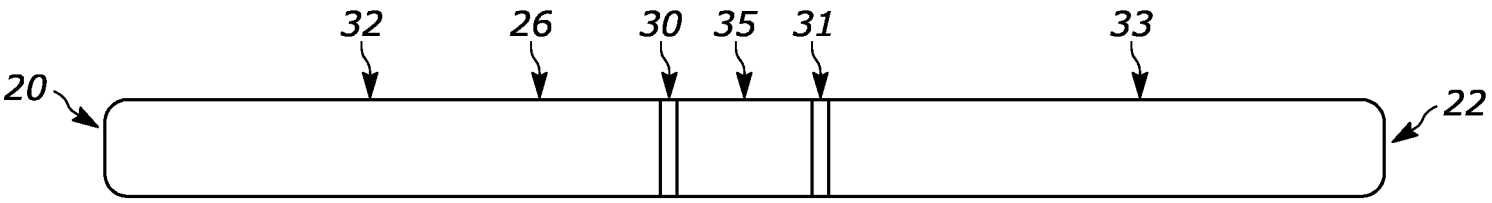
FIG. 4 of the drawings is a side elevational view of the embodiment of the soft tissue mobilization device shown in FIG. 3.
Figure 5:
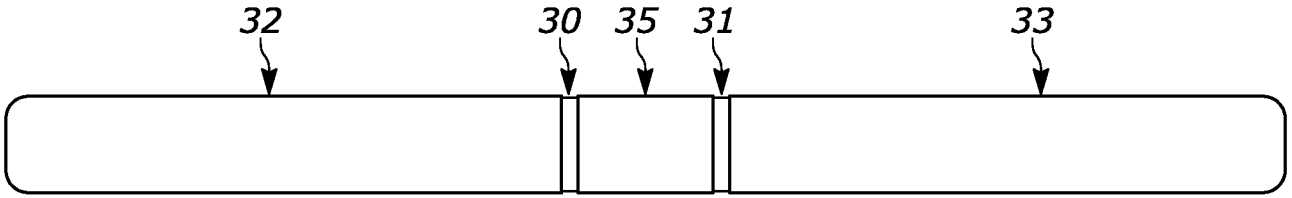
FIG. 5 of the drawings is a side elevational view of the embodiment of the soft tissue mobilization device shown in FIG. 3.
Figure 9:
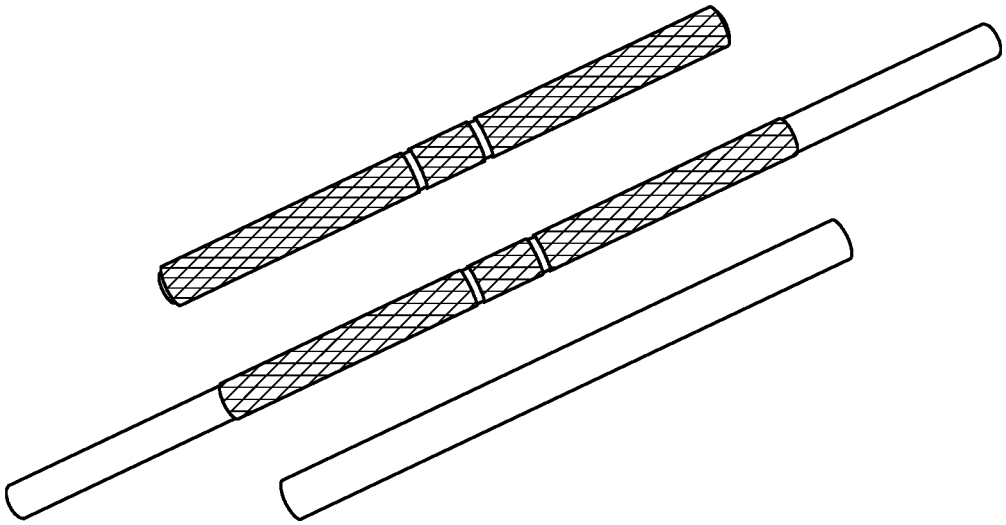
FIG. 9 of the drawings is a top plan view of three different embodiments of the soft tissue mobilization device.
Figure 10:
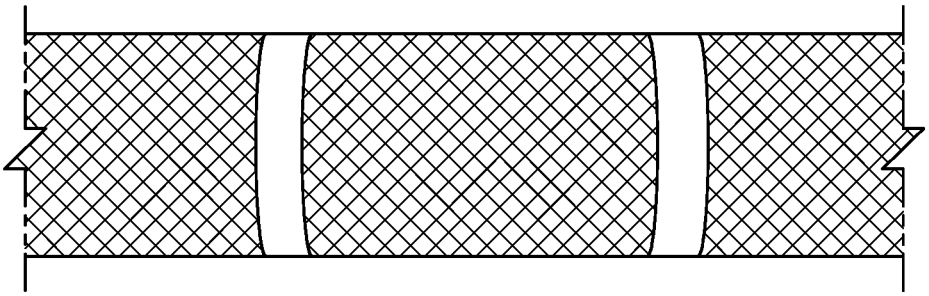
FIG. 10 of the drawings is a side elevational view of a portion of the soft tissue mobilization device shown in FIG. 9, showing the knurling thereon.

In a configuration, shown in FIGS. 3 through 5, a knurling, such as single Olympic knurl marks may be extended throughout the length of the elongated body, for example, up to the round at the first and second ends. One such pattern is shown in FIG. 10. The underlying inner diameter of the knurled section is approximately 1.125" with the outer diameter of the knurled section being approximately 1.1365" to 1.137" with other dimensions contemplated as well. It will be understood that the depth of the knurl can be varied without departing from the scope of the disclosure. In some configurations, a pair of slots can be cut into the elongated bar as surface variations. Such slots 30, 31 are approximately 0.197" in the configuration shown (although different widths are contemplated) with a central portion 35 being approximately 1.759" wide therebetween, which is centered on the elongated body. In the configuration shown, the wings 32, 33 are approximately 6.924" and again even on both sides.

In another configuration, shown in FIGS. 6 through 8, the elongated bar is closer to approximately 30". Such a configuration has the same central configuration of the central portion 35 with the slots 30, 31. However, the construction of the wings 32, 33 is of a varied structure. The initial 7.43" of one wing is knurled, with an outer diameter of the knurled portion being approximately 1.1365". The initial 7.480" of the other wing is knurled. The remainder of each wing, namely approximately 6.469" on either wing is uniformly smooth. It will be understood that in the configuration shown, the knurled section of one of the wings is slightly longer than the other, and this may provide additional utility.

In the preferred configurations, the bar is substantially inflexible even with a central load of approximately 300 pounds or more. That is, the elongated bar, when positioned in the position shown in FIGS. 13 and 14 between two stands, has a negligible flexion even with at least a 300 pound load centrally positioned. One such elongated bar is formed from the same materials utilized for the Ohio Bar or the Echo Bar from Rogue Fitness of Columbus, Ohio. The material has a tensile strength of about 190,000 PSI or greater. Of course, lesser tensile strengths are contemplated as long as the flexion over the different lengths when mounted as shown are minimal, and certainly plastic deformation is precluded over such lengths and application of forces. Indeed, the elongated bar may be able to withstand substantially more than 300 pounds without having plastic deformation or the like.

Figure 11:
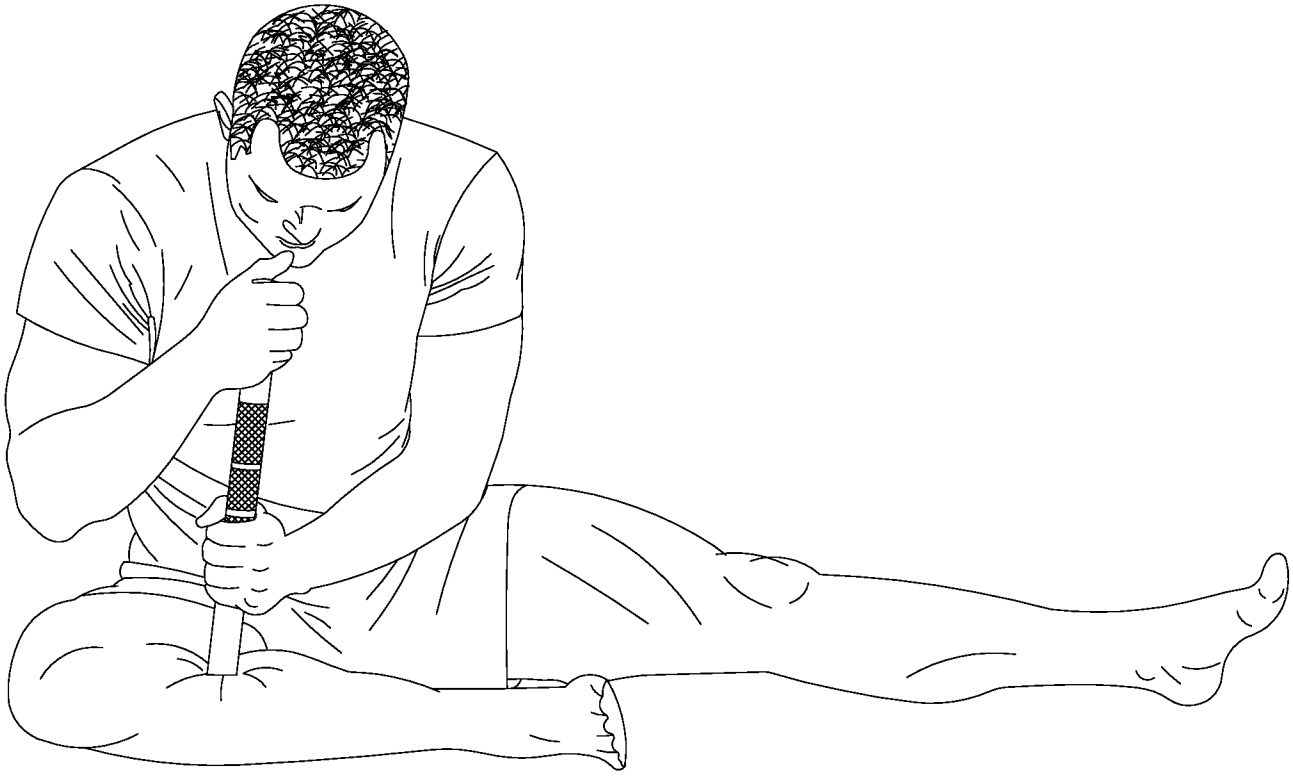
FIG. 11 of the drawings is a photograph of a manner of using the soft tissue mobilization device.
Figure 12:
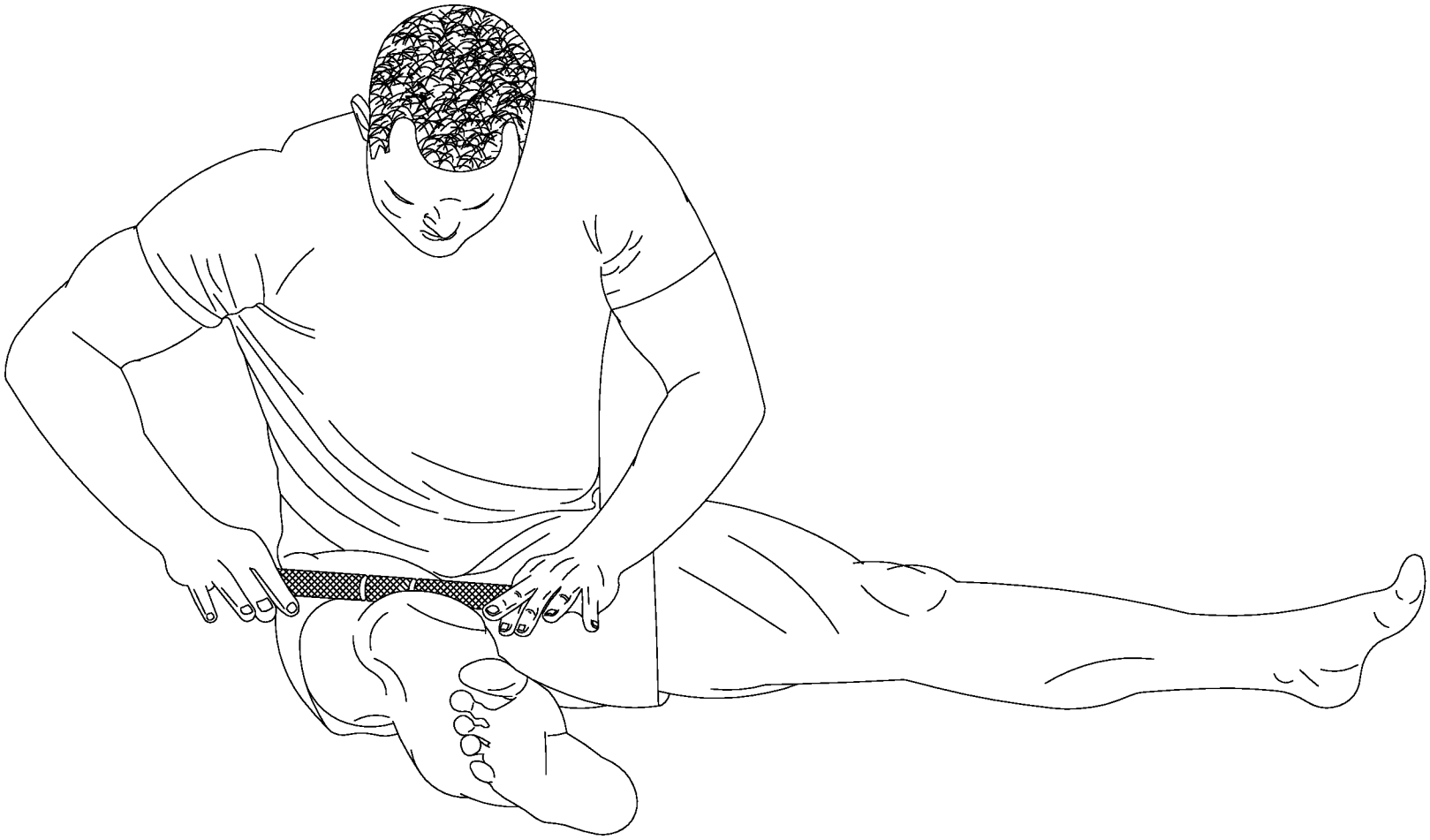
FIG. 12 of the drawings is a photograph of another manner of using the soft tissue mobilization device.
Figure 13:
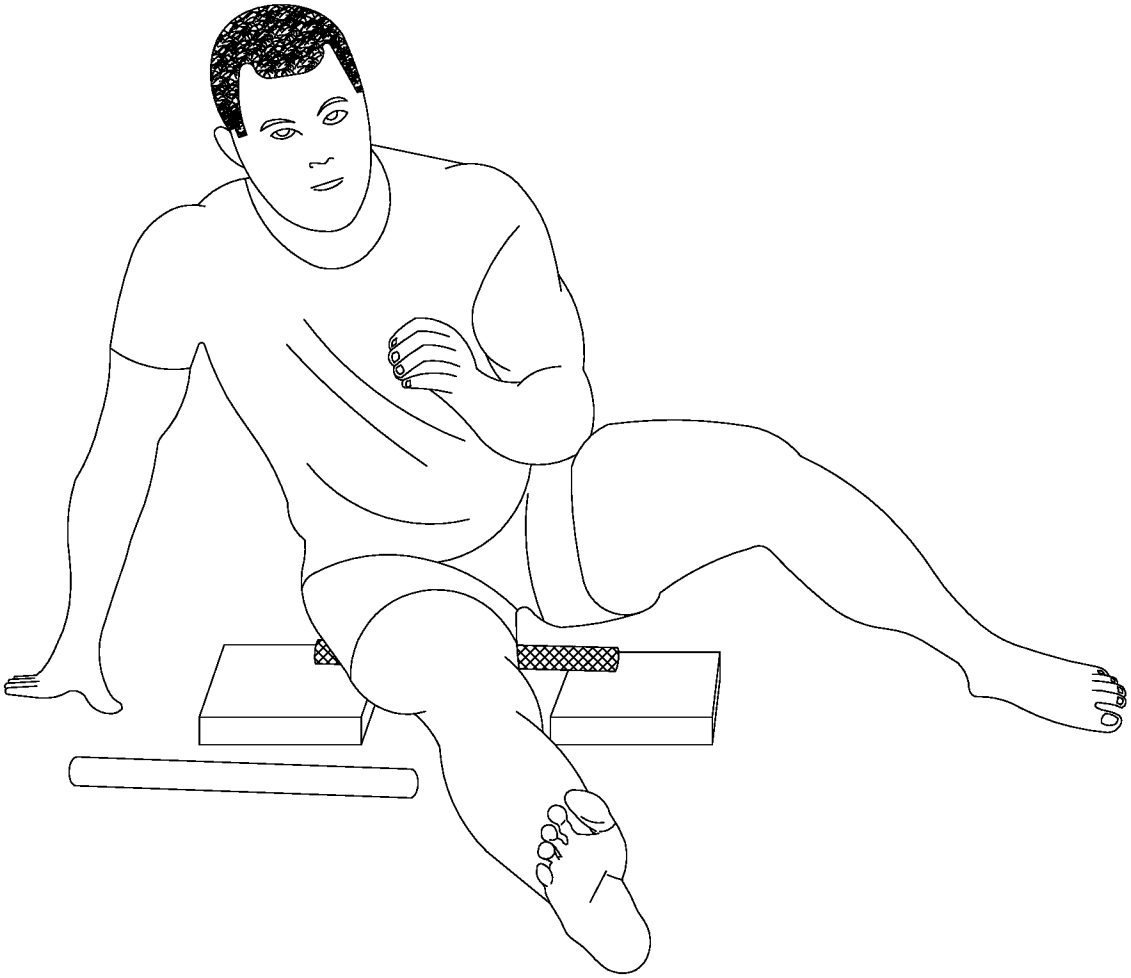
FIG. 13 of the drawings is a photograph of another manner of using the soft tissue mobilization device, with the device being positioned on a stand.
Figure 14:
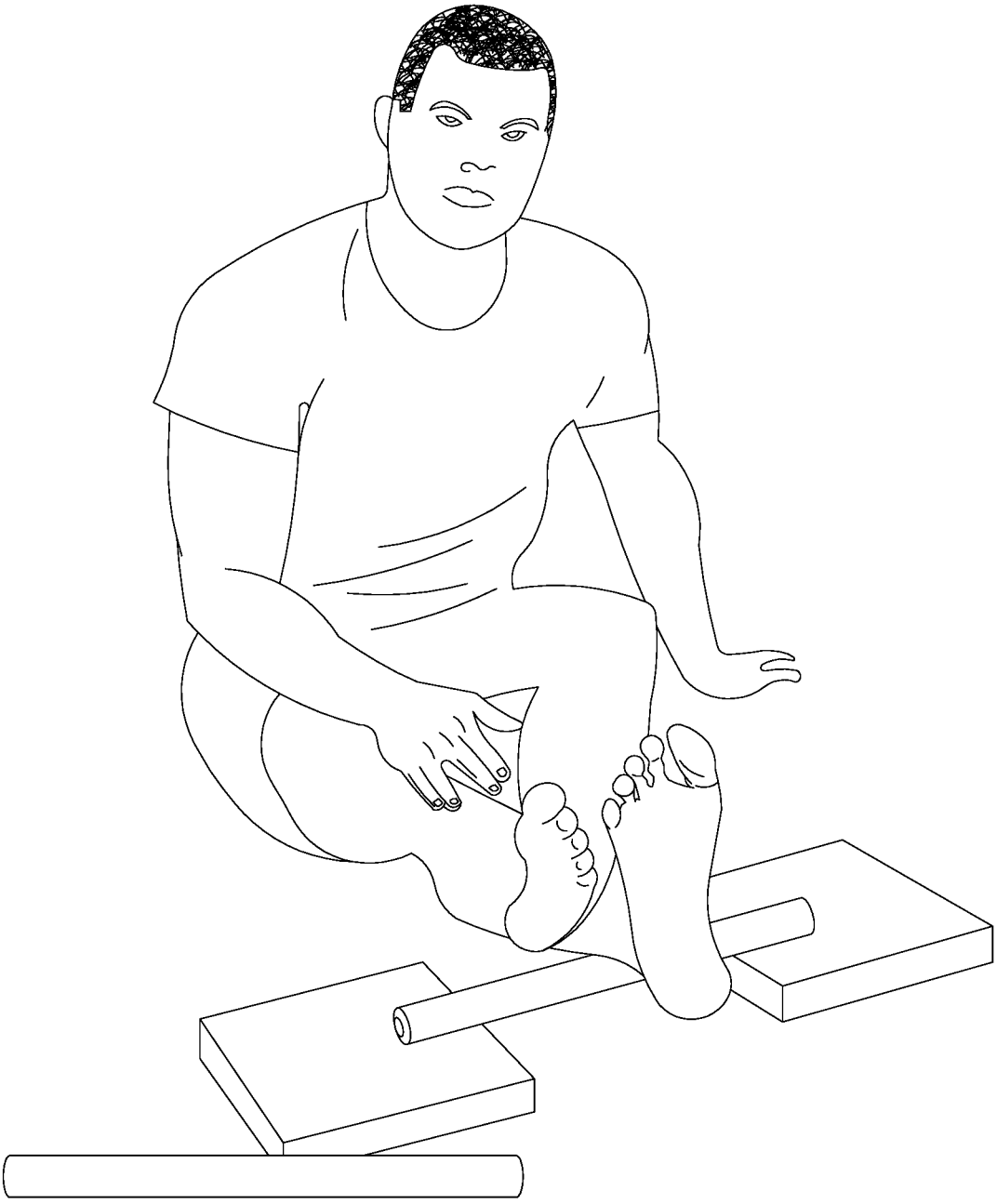
FIG. 14 of the drawings is a photograph of another manner of using the soft tissue mobilization device, with the device being positioned on a stand.

In use, the user can dig the first end and the second end into soft tissue. Due to the flat design with rounds on the ends, the first and second ends are formed to apply the pressure necessary along a large enough surface area so as to provide benefit without being detrimental to the user. Such a manner of use is shown in FIG. 11. Additionally, in other configurations, the user can grasp on either wing and roll or push the elongated body into the tissue to begin to break tissue up and to treat the affected areas. Such a manner of use is shown in FIG. 12. Finally, the user can place the elongated body on spaced apart stands (i.e., books, blocks or the like) and apply force by sitting or pressing tissue onto the elongated bar. Such a use is shown in FIGS. 13 and 14. More uses of the soft tissue mbiliztion device can be seen in the video entitled "Kelly Starrett talks the new MWod Mobility Stick" located at: https://www.youtube.com/watch?v=Dj_qVIEJ3Ow.

Figure 15:
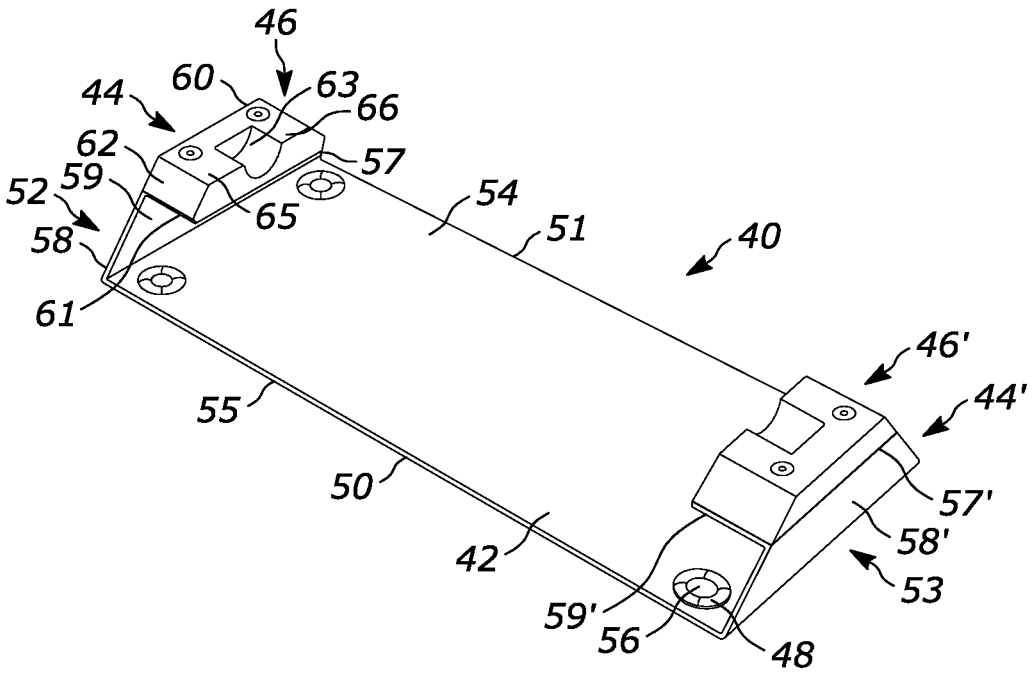
FIG. 15 of the drawings is a perspective view of the stand configured for use in association with the soft tissue mobilization device.
Figure 16:
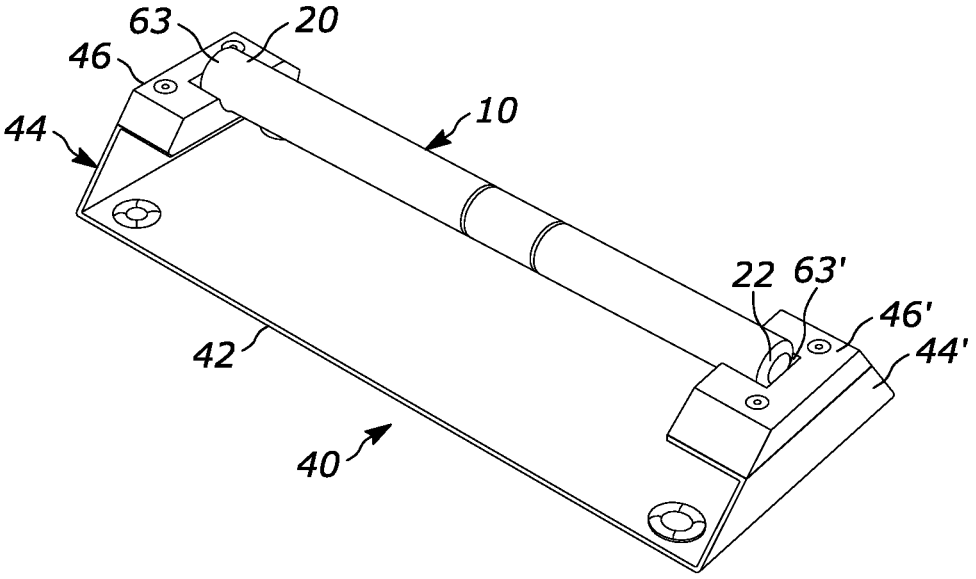
FIG. 16 of the drawings is a perspective view of the combination of the stand and the soft tissue mobilization device.

One configuration of the stands described above and shown in FIGS. 13 and 14 are disclosed in another configuration in FIGS. 15 and 16. With particular reference to FIG. 15, the stand is shown generally at 40. The stand includes base 42 having opposing wall structures 44, 44' and cradle structures 46, 46'. The base 42 along with the opposing wall structures, in the configuration shown comprises a substantially planar sheet metal that is formed into the desired configuration, although other materials are contemplated, including but not limited to, wood, polymers and composites.

In the configuration shown, the base 42 includes front edge 50, back edge 51, first side 52 and second side 53. The base 42 defines an upper surface 54 and a lower surface 55. A plurality of openings 56 are disposed in a spaced apart configuration proximate each of the corners of the base. The opposing wall structures are formed from the same material as the base. It will be understood that the opposing wall structure 44 and the opposing wall structure 44' are substantially identical, and, as such, the opposing wall structure 44 will be described in detail with the understanding that the opposing wall structure is substantially a mirror image thereof.

The opposing wall structure 44 includes upstanding wall portion 58 and inward flange 59. The upstanding wall portion is substantially perpendicular to the base 42, with the inward flange 59 being substantially perpendicular to the upstanding wall portion, or substantially parallel to the base 42, and spaced apart therefrom. The inward flange 59 essentially overlies the base. In the configuration shown, the upstanding wall tapers away from the front and back edges as extending away from the base, so as to define a substantially trapezoidal configuration. As such, the inward flange is inwardly spaced apart from the front edge and the back edge of the base. In the configuration shown, the openings 56 of the base are visible from a top plan view and generally not obstructed by the inward flange. The inward flange 59 includes mounting surface 57.

The foot structure grommets 48 can be coupled to the openings 56 so as to provide four resilient points of contact of the base with the underlying ground or outside surface. It will be understood that these openings can be utilized as fastening points to couple the stand 40 to an outside structure. For example, screws can be driven through the openings to sandwich the base between the screw head (or washer used therewith) and an outside surface. In other configurations, the stand may be free standing and precluded from movement by the weight of the user and the friction between the outside surface and the foot structure grommets. In any event, it will be understood that the lower surface of the base generally overlies the outside base surface.

The cradle structure 46, 46' is positioned on the respective mounting surface 57, 57' of the inward flanges 59, 59'. The cradle structure 46 includes body 60 having base 61 and upper end 62. The upper end 62 includes slot 63 surrounded by peaks 65, 66. The slot 63 is configured to matingly capture the end of the elongated body 12 therein, and to retain the structure therein. The depth of the slot 63 is, in the configuration shown, less than the diameter of the elongated body, generally corresponding to the radius. It will be understood that the depth is sufficient to preclude the inadvertent and undesired removal of the elongated body from within the slot 63. The general shape of the cradle structure is substantially trapezoidal with the base 61 mounted on the mounting surface 57 and the two structures coupled together through the use of threaded fasteners.

It will be understood that the two slots 63, 63' are spaced apart sufficient so as to capture the opposing first and second ends 20, 22 of the elongated body relatively tightly without substantial back and forth play of the elongated body (i.e., side to side movement). It will be understood that the elongated body is capable of rotating along its longitudinal axis within the slots 63, 63', using the slots 63, 63' as defining the axis of rotation.

Figure 17:
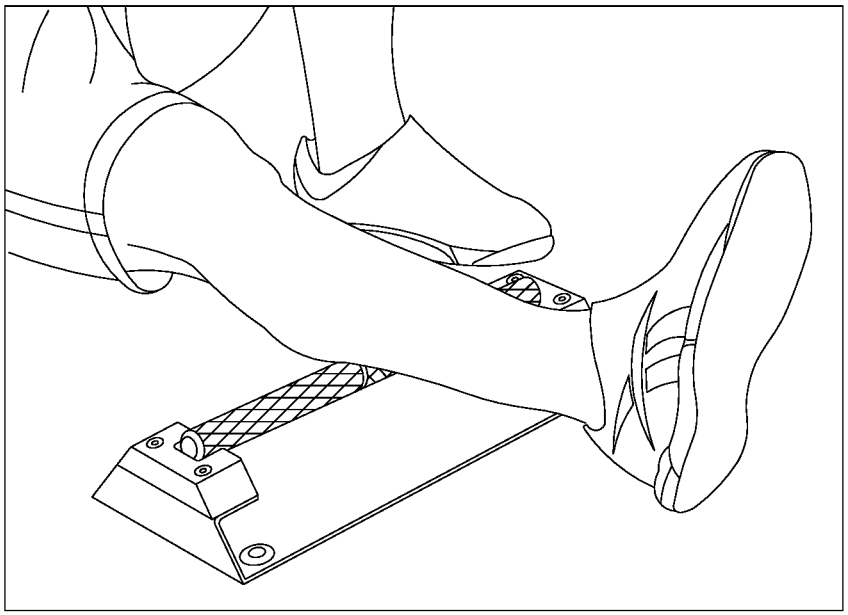
FIG. 17 of the drawings is a photograph of a manner of using the soft tissue mobilization device positioned on the stand.

In use, and with reference to FIG. 17, the user places the elongated body so that the opposing first and second ends are positioned within the slots 63, 63'. Once positioned, the stand with the elongated body can be redirected and positioned as desired on an outside surface. Alternatively, the stand can first be positioned in a desired location (and optionally coupled to the outside surface), prior to the placement of the elongated body within the slots.

Once positioned, the user can utilize the device in much the same fashion that is described above in the operation of the device. At any time, the user can remove the elongated body from within the slots 63, 63' and can then utilize the elongated body in the manners described above.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A soft tissue mobilization device comprising an elongated body having a first end, a second end, and a cross-sectional configuration, wherein the elongated body has a tensile strength of at least 190,000 PSI and a substantially constant diameter from the first end to the second end, the elongated body including a first slot and a second slot disposed into a circumference of the elongated body, a first wing portion extending from the first end to the first slot, a central portion extending from the first slot to the second slot, and a second wing portion extending from the second slot to the second end, wherein an entirety of a length of each of the first wing portion, the central portion, and the second wing portion includes surface variations.

2. The soft tissue mobilization device of claim 1 wherein the cross-sectional configuration is substantially circular, so as to define a cylindrical configuration.

3. The soft tissue mobilization device of claim 2 wherein each of the first and second ends include a rounded edge.

4. The soft tissue mobilization device of claim 2 wherein the elongated body has a length that is between approximately 16" and approximately 30" in length.

5. The soft tissue mobilization device of claim 4 wherein the diameter is about 1.125".

6. The soft tissue mobilization device of claim 3 wherein the rounded edges comprise a radius of about 0.25".

7. The soft tissue mobilization device of claim 2, wherein the surface variations comprise a knurling, and wherein the knurling extends around the entire circumference of the central portion and along an entire length of the central portion, and the knurling further extends around the entire circumference of the first wing portion and the second wing portion and along at least a portion of a length of the first wing portion and the second wing portion.

8. The soft tissue mobilization device of claim 1 wherein the surface variations extending around an entire periphery of at least a portion of a length of the first wing, the central portion, and the second wing.

9. The soft tissue mobilization device of claim 1 wherein the surface variations comprise a knurling.

10. The soft tissue mobilization device of claim 1 wherein the elongated body is substantially symmetrical about the central portion.

11. A soft tissue mobilization device consisting of:

an elongated body having a first end, a second end, and a cross-sectional configuration, the elongated body including a first slot and a second slot disposed into a circumference of the elongated body, a first wing portion extending from the first end to the first slot, a central portion extending from the first slot to the second slot, and a second wing portion extending from the second slot to the second end, wherein an entirety of a length of each of the first wing portion, the central portion, and the second wing portion includes surface variations, wherein the elongated body has a tensile strength of at least 190,000 PSI, wherein the cross-sectional configuration is substantially circular from the first end to the second end, so as to define a cylindrical configuration, wherein the elongated body has a length that is between approximately 16" and approximately 30" in length, a diameter of approximately 1.125" from the first end to the second end, wherein each of the first and second ends have a rounded edge.

12. A combination stand and soft tissue mobilization device, wherein the stand comprises:

a base having a first side and a second side, the base having a lower surface and an upper surface opposite the lower surface, the lower surface positionable to overlie an outside surface; and a cradle structure positioned at each of the first side of the base and the second side of the base, each cradle structure including a slot defined between opposing peaks; and the soft tissue mobilization device comprises:

an elongated body having a substantially circular cross-sectional configuration and having a first end, a second end, a diameter that is substantially constant from the first end to the second end, the elongated body including a first slot and a second slot disposed into a circumference of the elongated body, a first wing portion extending from the first end to the first slot, a central portion extending from the first slot to the second slot, and a second wing portion extending from the second slot to the second end, wherein an entirety of a length of each of the first wing portion, the central portion, and the second wing portion includes surface variations, wherein, the first end is releasably positionable within the slot defined in the cradle structure at the first side and the second end is releasably positionable within the slot defined in the cradle structure at the second side, so as to span therebetween in a position that is spaced apart from the upper surface.

13. The combination stand and soft tissue mobilization device of claim 12 wherein the elongated body has a tensile strength of at least about 190,000 PSI.

14. The combination stand and soft tissue mobilization device of claim 12 wherein the elongated body is rotatable about an axis defined by the slots of the cradle structure at each of the first side and the second side of the base.

15. The combination stand and soft tissue mobilization device of claim 12 wherein the elongated body is substantially precluded from movement within the slot of each of the first and second side in a side to side direction.

16. The combination stand and soft tissue mobilization device of claim 12 wherein the surface variations comprise a knurling, and wherein the knurling extends around the entire circumference of the central portion and along an entire length of the central portion, and the knurling further extends around the entire circumference of the first wing portion and the second wing portion and along at least a portion of a length of the first wing portion and the second wing portion.

17. A stand configured to receive and retain a soft tissue mobilization device comprising:

a base having a first side and a second side, the base having a lower surface positionable to overlie an outside surface and the base having an upper surface opposite the lower surface, the base further including an opposing wall structure positioned at each of the first side and the second side of the base, each opposing wall structure comprising:

an upstanding wall extending upwardly from the upper surface of the base; and an inward flange extending from the upstanding wall spaced apart from the upper surface of the base, wherein the upstanding wall is substantially perpendicular to the base and the base and the opposing wall structure are integrally formed, and the inward flange is substantially parallel to the upper surface of the base;

a cradle structure positioned at each of the first side of the base and the second side of the base, each cradle structure including a slot defined between opposing peaks, wherein, the slot of each of the first side of the base and the second side of the base are spaced apart from each other and configured to receive the soft tissue mobilization device therebetween in a configuration that extends the soft tissue mobilization over the base in a spaced apart configuration; and wherein, the cradle structure of each of the first side and the second side are coupled to the inward flange on a mounting surface thereof.

18. A combination stand and soft tissue mobilization device wherein:

the stand comprises:

a base having a first side and a second side, the base having a lower surface and an upper surface opposite the lower surface, the lower surface positionable to overlie an outside surface; and a cradle structure positioned at each of the first side of the base and the second side of the base, each cradle structure including a slot defined between opposing peaks; and the soft tissue mobilization device comprises:

an elongated body having a substantially circular cross-sectional configuration and having a first end, a second end, a diameter, and a substantially constant diameter from the first end to the second end, the elongated body including a first slot and a second slot disposed into a circumference of the elongated body, a first wing portion extending from the first end to the first slot, a central portion extending from the first slot to the second slot, and a second wing portion extending from the second slot to the second end, wherein the first wing, the central portion, and the second wing include surface variations, wherein, the first end is releasably positionable within the slot defined in the cradle structure at the first side and the second end is releasably positionable within the slot defined in the cradle structure at the second side, so as to span therebetween in a position that is spaced apart from the upper surface;

wherein the base further includes an opposing wall structure positioned at each of the first side and the second side of the base, each opposing wall structure comprising:

an upstanding wall extending upwardly from the upper surface of the base; and an inward flange extending from the upstanding wall spaced apart from the upper surface of the base, wherein the upstanding wall is substantially perpendicular to the base and the base and the opposing wall structure are integrally formed, and the inward flange is substantially parallel to the upper surface of the base;

wherein, the slot of each of the first side of the base and the second side of the base are spaced apart from each other; and wherein, the cradle structure of each of the first side and the second side are coupled to the inward flange on a mounting surface thereof.

* * * * *